United States Patent [19]

Predelli

[11] Patent Number: 4,927,197

[45] Date of Patent: May 22, 1990

[54] SPRING-LATCH DOOR LOCK PROVIDED WITH AN IMPROVED LOCKING SYSTEM AND ADAPTED TO BE USED FOR INWARDLY AND OUTWARDLY OPENED DOORS

[76] Inventor: Piero Predelli, via Imbonati, 17, 20129 Milano, Italy

[21] Appl. No.: 246,352

[22] Filed: Sep. 19, 1988

[30] Foreign Application Priority Data

Jul. 22, 1988 [IT] Italy ..... 21463 A/88

[51] Int. Cl.[5] ..... E05C 1/16

[52] U.S. Cl. ..... 292/245

[58] Field of Search ..... 292/245, 153, 166, 173, 292/161, 167, 244

[56] References Cited

U.S. PATENT DOCUMENTS 3,881,758 5/1975 Gross ..... 292/DIG. 38 X
4,648,639 4/1987 Martin et al. ..... 292/153 X
4,726,613 2/1988 Foshee ..... 292/245 X

FOREIGN PATENT DOCUMENTS 31605 12/1933 Netherlands ..... 292/245

*Primary Examiner*—Richard E. Moore
*Attorney, Agent, or Firm*—Bucknam and Archer

[57] ABSTRACT

A lock comprising a spring-latch member rotatably coupled to a sliding block for assuming two fixed positions with respect to the sliding block, the sliding block being controlled by a rotating member provided for restraining a lug extending from the inner face of the block and driven by a lever arm operated by a handle.

6 Claims, 2 Drawing Sheets

Fig. 1
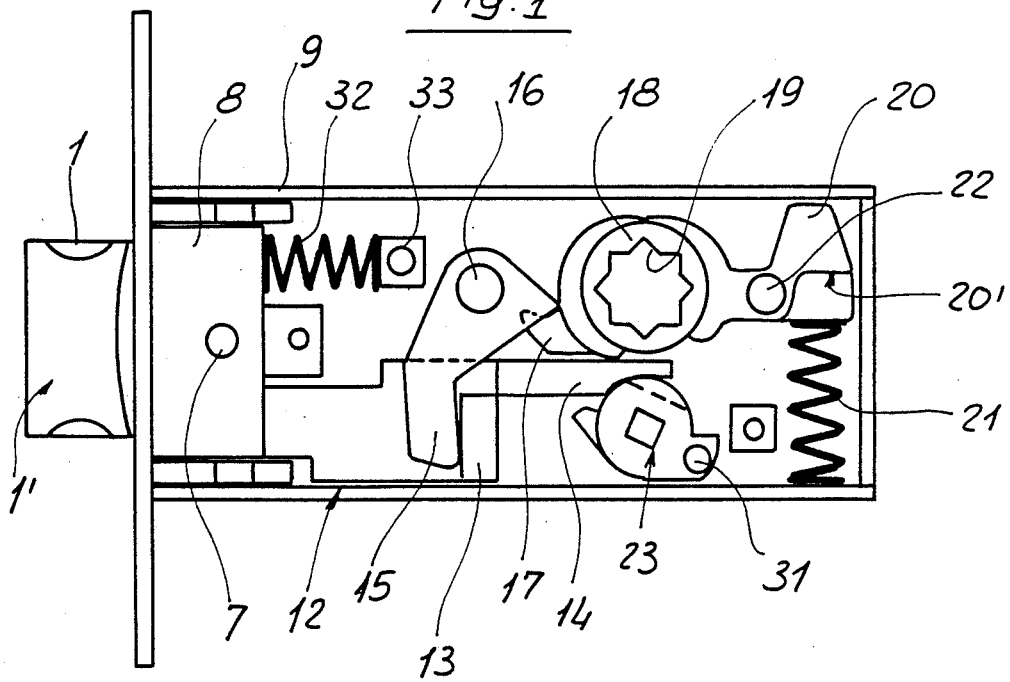
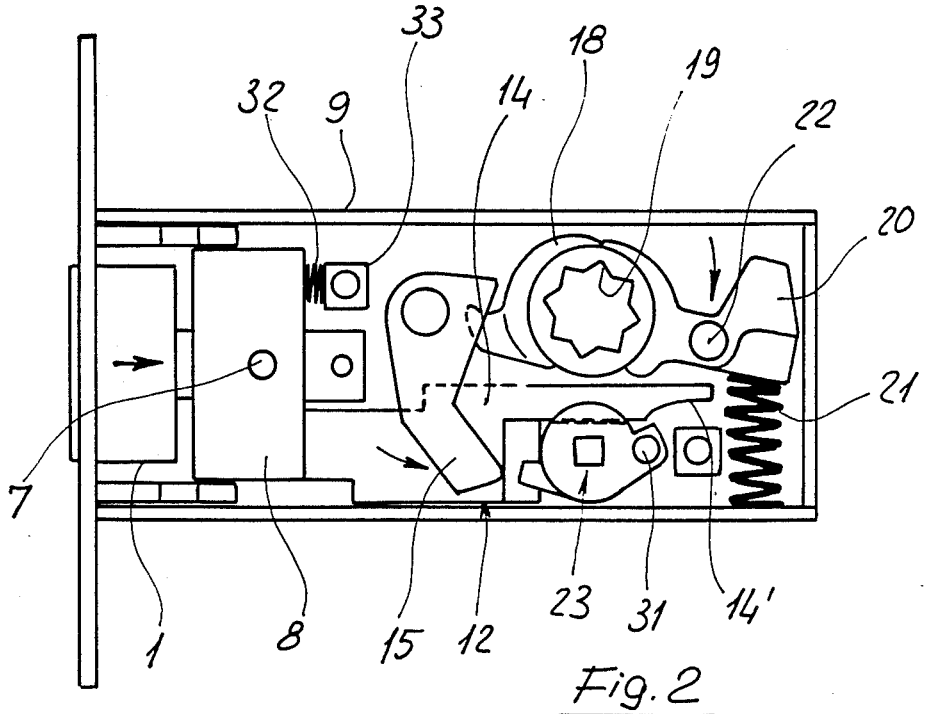
Fig. 2

1
1'
2
3
4
5
6
7
8
9
10
11
12
13
14
14'
23
24
25
26
27
28
29
30
31

SPRING-LATCH DOOR LOCK PROVIDED WITH AN IMPROVED LOCKING SYSTEM AND ADAPTED TO BE USED FOR INWARDLY AND OUTWARDLY OPENED DOORS

BACKGROUND OF THE INVENTION

The present invention relates to a spring-latch lock, provided with an improved locking system and adapted to be used both for inwardly and outwardly opened doors.

As is known, for closing given doors in homes, hotels, transport means and so on there are presently used simple spring-latch locks which can be snap engaged in the related selvage.

Also known is the fact that, in the above mentioned locks, the spring-latch member must have its slanted surface facing the closing direction of the door, so as to provide the mentioned snap engaging.

Because of this reason, two different types of locks are presently made, to be respectively applied to doors to be closed inwardly and doors to be closed outwardly.

On particular types of doors, moreover, there is the requirement of providing a closure locking which negatively affects the construction of the lock, which becomes very complex and of comparatively large size, with a not completely reliable operation.

SUMMARY OF THE INVENTION

Accordingly, the main object of the present invention is to overcome the above mentioned drawbacks, by providing a spring-latch door lock which may be advantageously used both on inwardly and outwardly opened doors.

Another object of the present invention is to provide such a spring-latch door lock which is provided with an improved locking member for locking the door in its closed condition.

Another object of the present invention is to provide such a spring-latch door lock which is very simple construction-wise and which, moreover, is very reliable in operation.

According to one aspect of the present invention the above mentioned objects, as well as yet other objects, which will become more apparent hereinafter, are achieved by a spring-latch door lock, provided with an improved locking system and adapted to be used both for inwardly and outwardly opened doors, characterized in that said lock is provided with a spring-latch member rotatably coupled to a sliding block and able of assuming two fixed positions with respect to said block, the sliding of said block depending on the position of a rotating member able of restraining the movement of a shaped lug extending from the inner face of said block and driven by a lever arm in turn adapted to be driven by a handle.

BRIEF DESCRIPTION OF THE DRAWINGS

Further characteristics and advantages of the spring-latch door lock according to the present invention will become more apparent from the following detailed description of a preferred embodiment thereof, being illustrated, by way of an indicative but not limitative example, in the figures of the accompanying drawings, where:

FIG. 1 illustrates the inner mechanism of the subject lock, in its condition locking the spring-latch member;

FIG. 2 represent the same mechanism with the locking member in its spring-latch member disengaged condition;

DESCRIPTION OF THE PREFERRED EMBODIMENT

Figures 3, 4A, 4B, 5:
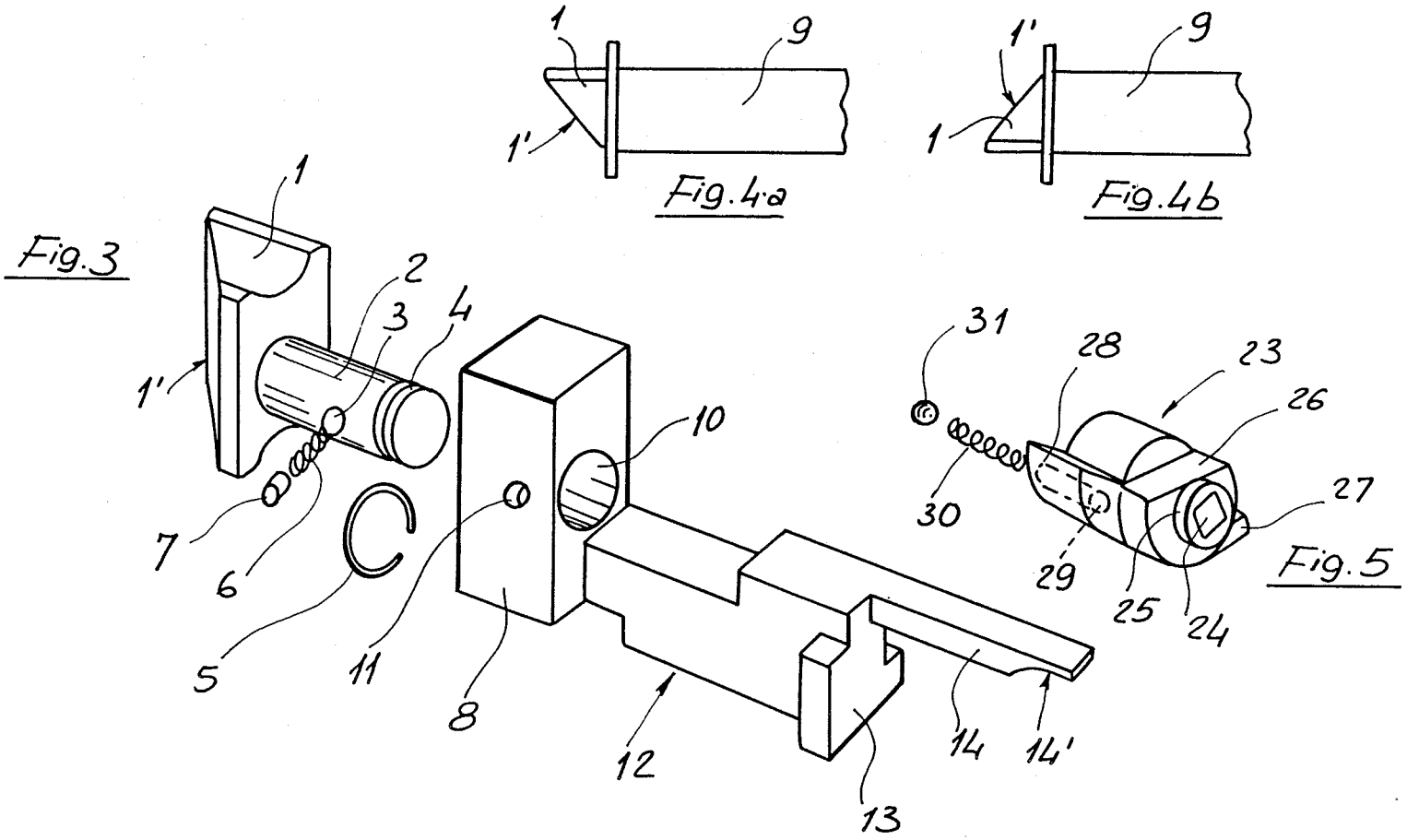
FIG. 3 is a perspective expolded view illustrating the spring-latch member and related sliding block.
FIGS. 4*a* and 4*b* illustrate the two positions which may be assumed by the spring-latch member, with respect to the mentioned sliding block.
FIG. 5 is a perspective view of the rotating locking member.

With reference to the figures of the accompanying drawings, the door lock according to the present invention comprises a spring-latch member 1, mounted on a cylindrical rod 2 provided with a blind radial hole 3 and including, at its free end, at least a circumferential slot 4.

This slot is adapted to house a resilient ring member 5 whereas, in the mentioned blind hole, there is housed a small spring 6 biassing a pin 7.

The cylindrical rod is rotatably coupled to a small block 8, effective to slide along the box-like body 9 including the operating mechanism of the door lock.

More specifically, the rod 2 may engage in a corresponding throughgoing hole 10 axially formed of said small block and provided, in turn, with a pair of radially extending holes 11, diametrically opposite to one another, in one of which there are housed the mentioned pin and spring.

Thus, owing to the providion of the mentioned type of coupling, it will be possible (as shown in FIGS. 4*a* and 4*b*) to arrange the slanted surface 1' of the spring-latch member in the closing direction of the door thereon the subject door lock will be assembled.

In order to carry out this reversal of orientation, it will be sufficient to disengage the cylindrical rod from the sliding block 8, by pressing, by means of a pointed member, the pin 7 through the hole 11 and rotating said rod so as to cause said pin to engage in the diametrically opposite hole.

It should be apparent that the block 8, which is preferably made of fiber reinforced nylon material, or any other autolubricating material, extends, in particular starting from its inner face, with a shaped lug, indicated overally by the reference number 12.

More specifically, the mentioned lug 12 is provided with a cantilever side portion 13 and a rear extension 14 ending with a portion 14' tapering at the bottom.

The rectilinear displacement of the mentioned block is obtained by partially rotating a lever arm 15, pivoted, by a pivot pin 16, to the two main walls of the box-like body 9.

The rotary movement of the lever arm, in particular, is performed by a hook-like member 17 which radialyy projects with respect to a substantially ring like structure 18.

This ring structure, in particular, is effective to define the impression of a square member 8, or walnut member 19, and extends, also radially, with a further portion 20 which is substantially opposite to said hook member.

This portion defines, in turn, an abutment 20' adapted to engage with a biassing spring 21 and supports, cantilever-wise, on both faces, a peg 22 engaging in corresponding circle are slots (not shown) provided in the walls of the box-like body 9.

With the extension of the mentioned shaped lug a member cooperates which is able of rotating, and indicated overally at the reference number 23, said member being provided with a throughgoing hole 24 having preferably a square cross-section.

The rotating member has a cylindrical overall shape, with two coaxial end collars 25 adapted to provide a rotary coupling of said rotating member with the two walls of the box-like body including the door lock.

More specifically, said rotary member is provided, at one end thereof, with a reduced cross-section portion, indicated overally at 26, tangentially thereto a projecting portion 27 extends.

The remaining part of the rotary body or member is in turn provided with a projecting tangential portion 28 through the thickness of which there is longitudinally formed a blind hole 29.

In said hole a biassing spring 30 is engaged, therewith a small ball 31 engages effective to be received in one of two holes (not specifically shown) formed on the corresponding wall of the mentioned box-like body 19.

It should moreover be pointed out that the sliding block 8 is resiliently counterbiassed by a coil spring 32, coupled to a cross member 33 arranged between the two walls of the mentioned box-like body.

In particular, as the rotary member 23 is arranged in the position of FIG. 1, it will operate as a locking member for the extension 14 of the block 8, thereby preventing the latter from sliding and without any possibility of disengaging the spring-latch member 1 from the related selvage.

As the rotary member is arranged in the position of FIG. 2, vice versa, the block 8 will be able of inwardly sliding thereby the spring-latch member can be disengaged from the selvage.

In this connection it should be mentioned that the rotary movement of the mentioned locking member is obtained by using a suitable tool to be engaged with the member 24 and that the small ball 31 is able of acoustically signalling, by snap engaging in one or the other restraining holes, the variation of the position of said locking member.

From the above disclosure it should be apparent that the invention fully achieves the intended objects.

While the door lock of the invention has been disclosed and illustrated with reference to a preferred embodiment thereof, it should be apparent that the disclosed embodiment is susceptible to several modifications and variations all of which will come within the scope and spirit of the invention, as defined in the appended claims.

I claim:

1. A spring-latch door lock provided with an improved locking system to be used both for inwardly and outwardly opened doors, comprising a spring-latch member rotatably coupled to a sliding block for assuming two fixed positions with respect to said sliding block, said sliding block being controlled by a rotary restraining member provided for restraining a lug extending from an inner face of said sliding block and driven by a lever arm operated by a handle, wherein said spring-latch member is mounted on a cylindrical rod rotatably coupled to said sliding block and having a radial blind hole provided with at least a circumferential slot engaged by a resilient ring member, in said radial blind hole being engaged a spring biassing a restraining pin.

2. A door lock according to claim 1, wherein said cylindrical rod is rotatably coupled to said sliding block, said sliding block being adapted to slide along a box-like body therein there is housed an operating mechanism of said door lock, said cylindrical rod being adapted to engage in a corresponding throughgoing hole formed axially of said sliding block and provided with a pair of radial diametrically opposite holes in one of which there are engaged said spring and pin.

3. A door lock according to claim 1, wherein said shaped lug comprises a cantilever side portion and a rear extension ending with a portion tapering at the bottom thereof.

4. A door lock according to claim 1, wherein said lever arm is pivoted, by a pivot pin, on two main walls of said box-like body, said arm lever being rotatably driven through a hook like member which radially projects from a ring-like structure having an inner wall defining an impression of a walnut member and radially extending with a further portion opposite to said hook-like member, said further portion defining an abutment adapted to engage with a biassing spring and cantilever supporting on both faces thereof, a peg engaging in corresponding circle arc slots formed on said box-like body.

5. A door lock according to claim 1, wherein said rotary restraining member is provided with an axial throughgoing hole of square cross-section, said rotary member having a cylindrical shape with two coaxial end collars adapted to provide a rotary type of coupling with said box-like body.

6. A door lock according to claim 1, wherein said rotary restraining member comprises, at one end thereof, a reduced cross-section portion, tangentially therefrom a projection extends and a tangential projecting part including a longitudinal blind hole housing a biassing spring therewith a small ball is engaged which is further engaged in one of said two holes formed in said box-like body.

* * * * *